US005339624A

United States Patent [19]

Calsson et al.

[11] Patent Number: 5,339,624

[45] Date of Patent: Aug. 23, 1994

[54] RAMJET PROPELLANTS

[75] Inventors: Staffan Calsson; Hermann Schmid, both of Karlskoga, Sweden

[73] Assignee: Nobelkrut AB, Sweden

[21] Appl. No.: 796,806

[22] Filed: Nov. 25, 1991

[30] Foreign Application Priority Data

Nov. 23, 1990 [SE] Sweden ..... 9003723-5

[51] Int. Cl.[5] ..... C06B 21/00; C06B 115/10

[52] U.S. Cl. ..... 60/207; 60/219; 149/19.1; 149/108.2; 149/109.6

[58] Field of Search ..... 149/19.1, 108.2, 109.6; 60/207, 219

[56] References Cited

U.S. PATENT DOCUMENTS

| | | | |
|---|---|---|---|
| 3,122,429 | 2/1964 | Toulmin | 44/51 |
| 3,503,814 | 3/1970 | Helms et al. | 149/108.2 |
| 3,690,849 | 9/1972 | Bredzs et al. | 149/108.2 |
| 3,732,132 | 5/1973 | Merrow et al. | 149/19.3 |
| 3,841,929 | 10/1974 | Craig | 149/17 |
| 3,976,989 | 7/1976 | Hawthorne | 149/19.2 |
| 3,986,909 | 10/1976 | Macri | 149/19.9 |
| 4,315,786 | 2/1982 | English | 149/108.2 |
| 4,331,080 | 5/1982 | West et al. | 149/92 |
| 4,332,631 | 6/1982 | Hertz et al. | 149/19.2 |
| 4,363,679 | 12/1982 | Hagel et al. | 149/37 |
| 4,392,895 | 7/1983 | Reed et al. | 60/207 |
| 4,416,710 | 11/1983 | Anderson | 149/19.91 |
| 4,419,153 | 12/1983 | Boberg | 149/22 |
| 4,420,931 | 12/1983 | Anderson | 149/19.92 |
| 4,853,052 | 8/1989 | Calsson et al. | 149/22 |
| 5,085,717 | 2/1992 | Berard et al. | 149/19.9 |
| 5,212,343 | 5/1993 | Brupbacher et al. | 149/108.2 |

FOREIGN PATENT DOCUMENTS

| | | |
|---|---|---|
| 1279961 | 6/1972 | United Kingdom . |
| 1384870 | 2/1975 | United Kingdom . |
| 1386542 | 3/1975 | United Kingdom . |

*Primary Examiner*—Edward A. Miller

*Attorney, Agent, or Firm*—Pollock, Vande Sande & Priddy

[57] ABSTRACT

The present invention relates to a general method for increasing the energy conversion from metal-containing rocket and ramjet propellants. According to the invention, this is achieved by means of combining the combustion of the fuel with exothermic intermetallic alloying reactions between components incorporated in the fuel.

The invention also concerns rocket and ramjet propellants formulated in accordance with the abovementioned method.

6 Claims, No Drawings

RAMJET PROPELLANTS

The present invention relates to a method for increasing the energy conversion from and primarily the gas temperature of rocket and ramjet propellants with the aid of exothermic intermetallic reactions which are driven more or less in parallel with the combustion of explosives incorporated in the fuel and, if appropriate, other combustible substances, such as, for example, binders. The invention permits the production of smaller rockets and ramjet engines than hitherto, or alternatively more powerful ones. The one fundamental difference between the rocket propellants produced in accordance with the invention and corresponding ramjet propellants is that the rocket propellants also contain the oxygen addition necessary for combustion of the fuel, whereas the pure ramjet propellants use exclusively for their combustion the atmospheric oxygen from the surrounding atmosphere. In addition, there is the type of ramjet fuel which is precombusted in a gas generator by means of its intrinsic oxygen content and is thereafter subjected to postcombustion in accordance with the afterburner chamber principle with the aid of atmospheric oxygen from the surrounding atmosphere.

Rocket and ramjet propellants often contain various subcomponents which are in each case usually considered as secondary or high-energy explosives, such as HMX, RDX, HNS, PETN, TNT etc, and furthermore it is not uncommon for there to be an addition of aluminum powder in order to increase the effect.

It is thus previously known that the energy conversion from such rocket and ramjet propellants can in purely general terms often be increased by means of a metal addition. In EP-A-0323828, which additionally deals with explosives mixtures and rocket and ramjet propellants almost as if it were a question of the same type of product, certain improvements are further described which, it is stated, can be obtained, as regards the energy conversion from such specific charges containing secondary explosives, perchlorates, aluminium powder and binder, if more account is taken of the side reactions which take place alongside the pure combustion. According to this patent specification, it should in fact be possible to achieve a significantly improved energy conversion from such explosives mixtures if, instead of adding the perchlorate part in large molar excess, as was previously the case, this is balanced carefully against the oxygen balance of the mixture to give an essentially complete formation of carbon dioxide and water upon combustion of the mixture. It is in fact stated that the large molar excesses of perchlorate previously used have, upon combustion of the charge, consumed large amounts of energy for the actual breakup instead of giving an energy boost. This reasoning thus applies to perchlorate-containing mixtures.

However, the present invention relates to a more general method for increasing the energy conversion from and primarily the gas temperature of rocket and ramjet fuels containing high-energy explosives of the type RDX, HMX, HNS, PETN, TATB, NTO, TNT and guanidine derivatives, such as TAGN, NIGU and guanidine nitrate, metal additions and binder, which, if appropriate, can be an energetic binder (i.e. a binder which is also an explosive) such as TNT or polyvinyl nitrate.

It is also possible to increase the specific impulse of a metal-containing explosives mixture in accordance with the same principles. However, this is described in another application filed at the same time as this application.

Abbreviations used in the application and generally in this field:

RDX=hexogen
HMX=octogen
HNS=hexanitrostilbene
PETN=pentyl or pentaerythritol tetranitrate
TATB=trinitroaminotrinitrobenzene
NTO=3-nitro-1,2,4-triazol-5-one
TNT=trinitrotoluene
TAGN=triaminoguanidine nitrate
NIGU=nitroguanidine According to the invention, the abovementioned higher gas temperature and consequently increased energy conversion in the form of a greater quantity of gas in the current rocket and ramjet fuels is achieved by virtue of the fact that the combustion of the explosives component incorporated therein is combined with an exothermic intermetallic reaction between components incorporated in the fuel which is started up by the explosives combustion but which, as soon as the reaction has got under way, continues without further energy addition, but with the release of energy. The temperature boost obtained in this way gives the fuel according to the invention a considerably greater energy density, which thus results in a higher impulse.

In order for this to function, the metal reactants must be soluble in each other at least at a temperature which is reached upon the explosives combustion, since it is the solubility reaction which is the most exothermic reaction stage.

It must also be taken into account that, in the alloy thus formed, oxides and, possibly, carbides may form in a second stage in accordance with essentially the same principles as apply to the rocket and ramjet propellants which contain only a single metal addition, and primarily aluminum. This second oxidation and carbide formation stage is not by a long way as strongly exothermic as the first alloying stage according to the invention.

Within the scope of the invention there is room for such differences as are due to the fact that the rocket propellants must also contain oxygen necessary for combustion, whereas the ramjet propellants make use of the surrounding atmospheric oxygen. In addition, the more detailed composition of the ramjet propellant depends on whether it is to be used in a ramjet engine with open combustion or in one where a first combustion takes place in a gas generator, while the final ramjet combustion takes place in the form of an afterburning with the aid of the atmospheric oxygen.

For rocket and ramjet propellants designed in accordance with the present invention, the following general limits apply for the different components incorporated therein.

Combustible binder 10–50 % by weight
Metal components 10–90 % by weight
Explosive 10–50 % by weight In the case of rocket propellants and also ramjet propellants precombusted in gas generators, oxygen releasers are also required to a greater or lesser extent. It is generally true that rocket and ramjet propellants contain relatively high levels of combustible binder.

Exothermic intermetallic alloying reactions which are of particular interest in this context are primarily those which give rise to borides, silicides, aluminides, alloys containing alkaline-earth metals and carbides.

Since the carbide formation between a metal and carbon from the explosive incorporated in the rocket or ramjet fuel can here be regarded as taking place according to the same premises as other intermetallic reactions in this context (i.e. completely between actual metals), we have therefore considered it correct to include also within the meaning of intermetallic reactions the reaction between a metal (for example Zr) and carbon from the explosives component of the fuel. Zirconium (Zr) affords an especially good effect when it is included in ramjet engines, since, upon access to atmospheric oxygen, it begins to react even at a low temperature, but gives a high temperature.

Theoretical calculations show that the following metal combinations give exothermic alloying systems suitable for use in conjunction with the present invention.

Alkaline-earth metals

Barium plus either antimony, bismuth or tin.
Tin plus magnesium.
Calcium plus aluminum.
Strontium plus aluminum.
Beryllium plus aluminum.

Borides

Boron plus magnesium, carbon, silicon, titanium, zirconium, chromium, molybdenum, tungsten or manganese.

Aluminides

Aluminum plus copper, calcium, boron, titanium, zirconium; chromium, manganese, iron, cobalt, nickel, palladium and platinum.

Carbides

Carbon plus beryllium, calcium, strontium, barium, boron, aluminum, titanium, zirconium, chromium or manganese.

Silicides

Silicon plus calcium, carbon, titanium, zirconium, chromium, molybdenum and nickel.

Reactions of particular interest in connection with the invention are those which involve two or more of the metals titanium, boron, zirconium, nickel, manganese, aluminum, and also between zirconium and carbon. The combination which we consider should first gain practical application in rocket and ramjet engines is that between zirconium and nickel, where, in particular, the combination of 30% zirconium and 70% nickel has given very good results.

So that it will be possible for the intended exothermic intermetallic reaction to be started up by the combustion of the explosives component of the fuel and then continue without further energy addition, it is necessary that the reactants (metals) should be accessible and distributed in the fuel in intimate contact with each other, in suitable particle sizes (specific surface) and in suitable amounts. Since the reactants consist of two or more metals, this is achieved by producing cohesive granules, preferably of the order of magnitude of 100–200 μm, of fine metal particles of μ-size, and in which the granules each contain all the reactants.

The internal cohesion within the granules can be ensured with the aid of specific binders, Just as the cohesion within the charges, i.e. between the metal granules and the explosives component, must be ensured by means of a binder, and the latter can, as has already been pointed out, be an energetic binder, i.e. itself an explosive, or another binder, for example an acrylate.

Thus, although it has been previously known that certain intermetallic alloying reactions are exothermic, the resulting use of this has, as far as we know, never previously consequently been applied in connection with ramjet and rocket fuels.

Since the exothermic alloying reactions are relatively slow compared to the combustion of the explosives components incorporated in the fuel, the result is a slightly lower gas formation rate, but this is compensated many times over by the higher gas temperature which is obtained according to the invention.

The invention has been defined in the subsequent patent claims and will now be described in slightly greater detail in connection with the attached examples.

EXAMPLES

The following compositions indicate suitable ramjet propellants which, if they are supplemented with suitably adapted quantities of oxygen releasers of a conventional rocket propellant type, can also be used with advantage as rocket propellants.

The binders can consist either of thermosetting resins, thermoelastics or thermoplastics. The latter group contains in particular many suitable binders in the form of combustible acrylates, polyurethanes, polyesters or thermoplastic rubber.

EXAMPLE 1

25% by weight of binder
45% by weight of RDX
17% by weight of titanium
13% by weight of boron

EXAMPLE 2

25% by weight of binder
10% by weight of RDX
40% by weight of titanium
25% by weight of boron

EXAMPLE 3

25% by weight of binder
24% by weight of zirconium
6% by weight of boron
45% by weight of RDX

EXAMPLE 4

25% by weight of binder
10% by weight of RDX
52% by weight of zirconium
13% by weight of boron

We claim:

1. A method for fueling a ramjet comprising:

(a) providing at least one high energy explosive component selected from the group consisting of hexogen, octogen, hexanitrostilbene, pentaerythritoltetranitrate, trinitroaminotrinitrobenzene, 3-nitro-1,2,4-triazol-5-one, trinitrotoluene, triaminoguanidine nitrate, nitroguanidine, and mixtures thereof;

(b) providing cohesive granules containing a binder and at least two alloying components which are capable of forming an intermetallic alloy by an exothermic reaction, said granules having a size in the range of about 100 to about 200 μm, and said alloying components being selected to form an intermetallic alloy selected from the group consisting of:

zirconium-titanium, zirconium-tin, zirconium-nickel, barium-bismuth, barium-tin, barium-antimony, magnesium-tin, carbon plus at least one metal selected from beryllium, calcium, strontium, barium, aluminum, titanium, zirconium, chromium and manganese, silicon plus at least one element selected from calcium, carbon, titanium, zirconium, chromium, molybdenum and nickel, and aluminum plus at least one metal selected from calcium, strontium, beryllium, copper, titanium, zirconium, chromium, manganese, iron, cobalt, nickel, palladium and platinum, said at least two alloying components being incorporated in said explosive compound as fine particles in contact with each other;

(c) forming a combustible fuel mixture by mixing said explosive component with said granules, said explosive component and said granules being in amounts effective to produce a fuel suitable for ramjet combustion;

(d) loading the resulting fuel into a ramjet.

2. A method according to claim 1 wherein said at least two alloying components comprise zirconium and nickel.

3. A method according to claim 2 wherein said zirconium and nickel are present in a ratio zirconium to nickel of 30:70.

4. A method according to claim 1 wherein said at least two alloying components are selected to form an intermetallic alloy containing an alkaline earth metal and are selected from the group consisting of: barium-bismuth, barium-tin, barium-antimony, magnesium-tin, calcium-aluminum, strontium-aluminum and beryllium-aluminum.

5. A method according to claim 1 wherein said at least two alloying components are selected from two or more of titanium, zirconium, nickel, manganese and aluminum.

6. A method according to claim 1 wherein said at least two alloying components are zirconium and carbon.

* * * * *